United States Patent [19]

Zenos

[11] 4,020,605

[45] May 3, 1977

[54] ROOF UTILITY UNIT

[76] Inventor: Steven Zenos, 1520 Sagebrush Trail, SE., Albuquerque, N. Mex. 87123

[22] Filed: Feb. 9, 1976

[21] Appl. No.: 656,430

[52] U.S. Cl. ..... 52/66; 52/506; 126/270

[51] Int. Cl.[2] ..... E04B 1/346; E04B 1/38

[58] Field of Search ..... 52/66, 612, 496, 506, 52/1; 264/261; 404/47; 126/270, 271

[56] References Cited

UNITED STATES PATENTS

| | | | |
|---|---|---|---|
| 1,778,727 | 10/1930 | Rankin | 52/612 |
| 2,671,441 | 3/1954 | Harris | 126/270 R |
| 3,001,331 | 9/1961 | Brunton | 126/270 R |
| 3,244,186 | 4/1966 | Thomason et al. | 126/270 R |
| 3,946,944 | 3/1976 | Keyes et al. | 126/270 |

FOREIGN PATENTS OR APPLICATIONS

| | | | |
|---|---|---|---|
| 2,335,100 | 4/1974 | Germany | 52/506 |
| 1,351,722 | 5/1974 | United Kingdom | 126/270 |

*Primary Examiner*—Price C. Faw, Jr.
*Assistant Examiner*—Robert C. Farber
*Attorney, Agent, or Firm*—Wesley B. Taylor

[57] ABSTRACT

A reversible, all seasonal roof utility unit is disclosed adapted to be placed in juxtaposition with other like units in covering a substantial portion of a roof. The unit comprises a sheet member, preferably slotted, having a light-absorbing color on one side and a light-reflecting color on the opposite side. Elevating means elevates the sheet member with respect to the roof to form an air space therebetween. The sheet member is adapted for reversible positioning with respect to the roof, whereby the light-absorbing colored side is directed away from the roof during the colder seasons, and the light-reflecting colored side is directed away from the roof during the warmer seasons. Optionally, the roof itself can have a light-absorbing color, and the utility unit can having a light-reflecting color and be detachably secured with respect to the roof in an elevated position. In this embodiment, the light-reflecting side of the sheet is exposed during the warmer seasons, and the sheet member can be removed to expose the roof and its light-absorbing color during the colder seasons.

15 Claims, 7 Drawing Figures

ROOF UTILITY UNIT

BACKGROUND OF THE INVENTION

The present invention relates to a roof utility unit which in combination with other like companion units can protect and thermally insulate a roof of a building, both in the warmer or summer seasons and in the colder or winter seasons as well.

Roofs are constantly exposed to many weathering factors, especially the hot, baking sun during the warmer seasons, principally the summer, and to the colder temperatures and chilling blasts of wind during the colder seasons, principally the winter. Either extreme makes the inhabitation of a home uncomfortable and requires the expenditure of energy to maintain a comfortable, livable temperature, whether it be by air conditioning during the warmer seasons or the combustion of fuel during the colder seasons.

Although the present invention is not limited to flat roof constructions, this type of roof is peculiarly difficult to cool. In the southwestern regions of the United States, where the roofs of homes tend to be flat because of Spanish architectural influence, there may be less than ten inches of air space between a roof and an underlying ceiling. This area readily becomes overheated from the sun and loses its heat only at night and then very slowly. During the warmer seasons, it is not unusual for the temperature on an outside roof of a home of this construction to reach 200° F and even higher. By conductance and radiation, such heat works its way through the roof and into the air space and eventually into the home itself.

SUMMARY OF THE INVENTION

The present invention provides a roof utility unit designed to be used in combination with other, like companion units when placed in juxtaposition to define a secondary, thermal protective covering for a roof. The unit preferably is adapted for year-round, all seasonal use and for this purpose may be reversibly positioned to adapt to changing seasons, that is, from the warmer to colder seasons and vice versa.

In one form, the roof utility unit comprises a sheet member, which may have a polygonal outline, provided with a light-absorbing color such as black on one side and a light-reflecting color such as white on the opposite side. Elevating means elevate the sheet member with respect to the roof to form an air space therebetween.

In this manner, the sheet member is adapted for reversible positioning with respect to the roof. During the colder seasons, the light-absorbing colored side may be directed away from the roof. During the warmer seasons, the sheet member is reversed, and the light-reflecting colored side is directed away from the roof.

The elevating means may be integral either with the roof or with the sheet member or not integral with either. In the first-mentioned embodiment, the sheet member is merely reversed in position with respect to the elevating means to accomodate seasonal changes. In the second and preferred embodiment, the elevating means are integral with and disposed to that side of the sheet member having the light-absorbing color. Accordingly, when that side of the light-absorbing color is directed away from the roof during the colder seasons, the elevating means are also similarly directed away from the roof, such that the air space normally formed by the elevating means between the roof and sheet member is also eliminated and the sheet member directly contacts the roof. The elimination of the air space and direct contact of the sheet member and roof aid in the heat insulating function of the present utility unit for colder seasons. Alternatively, the elevating means need not be integral with either the roof nor the sheet member but merely serve as a physical spacer between those two parts and rest against the roof due to its own weight.

Optionally, the roof itself may have a light-absorbing color and the roof utility unit formed by a sheet member having a light-reflecting color on one side. Elevating means space apart the sheet member and roof and, preferably, is integral with either part while detachably secured to the other. In this embodiment, the light-reflecting colored side of the sheet member is exposed during the warmer seasons, and the sheet member can be removed and stored to expose the roof and its light-absorbing color during the colder seasons.

DESCRIPTION OF THE PREFERRED EMBODIMENTS

Figure 1:
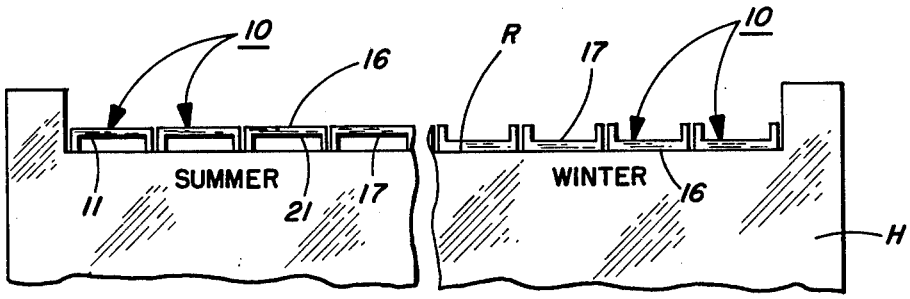
FIG. 1 is a side elevational view of a roof having utility units of the present invention, the view being vertically fragmented to show positioning of the units for the warmer seasons on the left hand side, and positioning of the units for the colder seasons on the right hand side.
Figure 2:
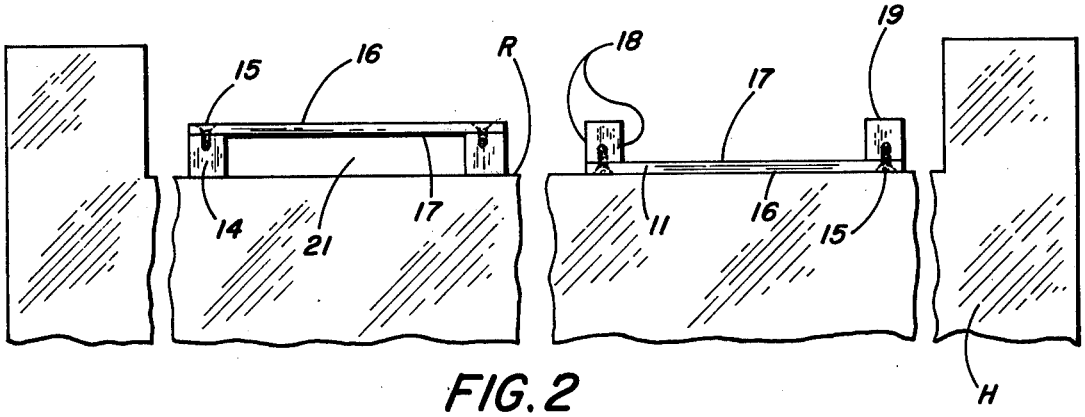
FIG. 2 is a side elevational, fragmentary view similar to FIG. 1 but illustrates an enlarged view of each of the positions for the warmer and colder seasons.
Figure 3:
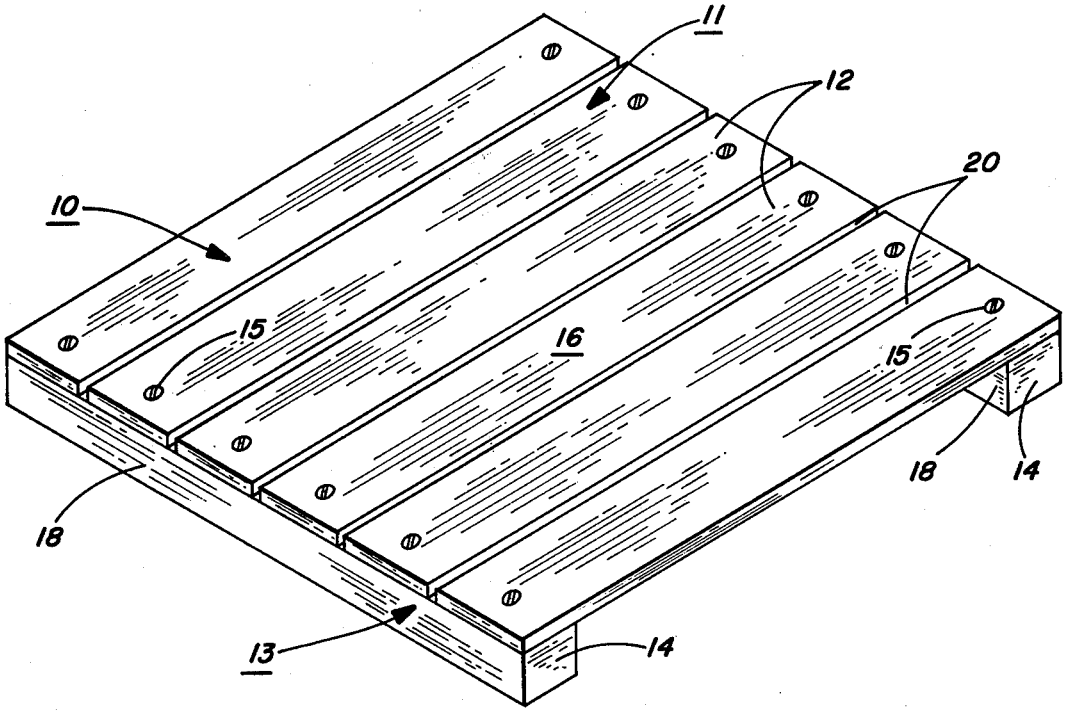
FIG. 3 is an isometric view of a roof utility unit of FIGS. 1 and 2 and shows openings in a sheet member of the unit.

Referring initially to the embodiment of FIGS. 1 through 3, a home H, which, for example, may be finished with a brick or stucco exterior, has a roof R. A plurality of roof utility units, generally represented at 10, extend in juxtaposed relation across the roof, preferably to cover its entire area. As shown especially in FIG. 3, each unit 10 may comprise a pallet-like structure including a sheet member 11, formed from a series of boards or slats 12, and elevating means 13 defined by opposed beams or runner means 14 which extend transversely along the ends of boards 12. Suitable fastener means such as screws 15 secure boards 12 and beams 14 together. Boards 12 are spaced apart on beams 14 to form air openings in the form of slots 20.

The boards and beams of a unit 10 may be formed from any suitable material such as wood, plastic, or metal. In the case of wood or plastic, fire retardants can be incorporated in a manner known in the art to render such material less susceptible to combustion.

Regardless of the nature of the material from which it is fabricated, unit 10 must have a light-absorbing color on one side and a light-reflecting color in the opposite side. The light-absorbing colors are the dark or "heavy" colors such as dark brown, green, carmine red, deep purples, and the like. The preferred light-absorbing color is black. Conversely, the light-reflecting colors are the "light" colors such as the pastel shades like pink, cream, beige, tan, pale yellow, and the like. The preferred light-reflecting color is white.

Thus, in the embodiment of FIGS. 1 through 3, side 16 of the units has a light-reflecting color, and the opposite side 17 has a light-absorbing color. Although not essential, both major faces 18 of beams 14 as well as its ends and bottom surfaces 19 may also have a light-absorbing color. While sheet members 11 are shown as rectangular, they can have any geometric outline, bounded either by curved or straight lines or both. Preferably the sheet members have any polygonal outline. Size is not at all critical. As an example, the sheet member may measure 4 feet by 4 feet to facilitate handling.

For use during the warmer seasons, a unit 10 and like companion units are placed as shown by the left hand portions of FIGS. 1 and 2, that is, with side 16 of the light-reflecting color directed away from roof R. In this position, elevating means 13 elevate sheet members 11 of each unit with respect to the roof to form an air space 21 therebetween. Not only does each sheet member 11 shade the roof, but the light-reflecting color of side 16 reflects the sun and other heat energy radiated toward the roof. Roof R never receives the direct rays of the sun and therefore maintains the roof and interior temperatures of home H considerably lower than otherwise would be the case. Moreover, air space 21 and openings 20 allow air to circulate between a sheet member 11 and roof R to withdraw heat and perform a further cooling action. The provision of openings 20 also lowers the resistance of units 10 to wind, such that they are much less likely to be blown away by the wind.

Conversely, during the colder seasons, it is desired that the sun heat the roof as much as possible. In this event, units 10 are placed in reversed position, that is, turned 180°, as illustrated by the right hand portions of FIGS. 1 and 2. In this position, side 17 of the light-absorbing color is directed away from room B. Elevating means 13 are also directed away from the roof with the result that the former air space 21 is eliminated and sheet member 11 directly contacts the roof. In this position also, side 17 absorbs the heat of the sun or other energy radiated toward the roof and aids in the sheet insulating function of the home. Further, since air space 21 is eliminated, there can be no cooling effect due to wind passing between an insulating unit and the roof and blowing away any warm air layer that accumulates there.

The previously described embodiment, in which the elevating means is integral with the shading sheet member, is preferred for installations on previously constructed homes. However, if desired, the elevating means can be integral with the roof and carry an overlying sheet member. This embodiment, illustrated by FIGS. 4, 5, and 6, can be used for homes under construction and installed at the time the roof is completed.

Figure 4:
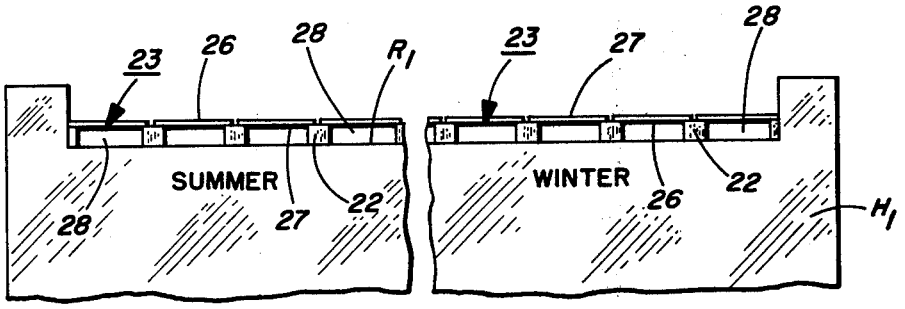
FIG. 4 is a side elevational view of a roof, similar to FIG. 1, having modified utility units of the present invention.
Figure 5:
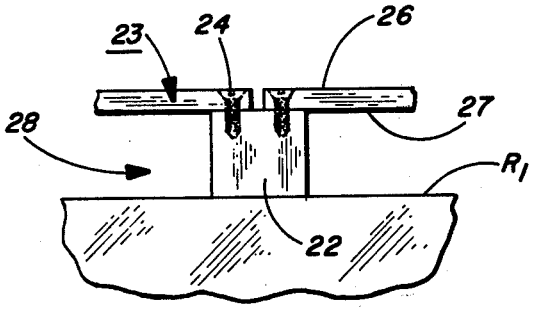
FIG. 5 is an enlarged, fragmentary view of one manner of detachably securing a sheet member of a unit of FIG. 4 with respect to a roof.
Figure 6:
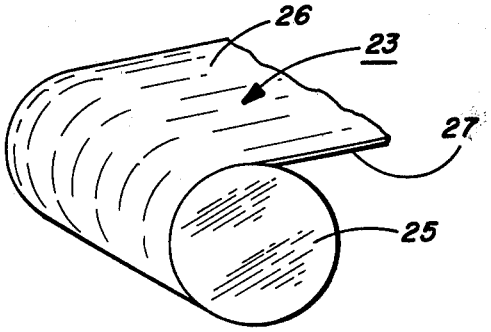
FIG. 6 is an isometric view of a roll of material which may be used to form sheet members of the present utility units.

Referring to FIGS. 4, 5, and 6, a home $H_1$ has a roof $R_1$ provided with integral channels or beams 22 which are spaced apart and extend from one end of roof $R_1$ to the other. It will be understood that beams 22 need not be made integral with roof $R_1$ at the time of construction. Conveniently, means of integrating the beams and roof are built into the roof to which beams 22 may be secured at a later time and still later removed if desired. The beams may be formed from any suitable material such as wood or metal like aluminum which, optionally, may be covered with suitable coating such as plaster, cement, stucco, and the like. A sheet member 23 bridges adjacent beams 22 and runs parallel to the direction of the beams. Suitable fasteners such as screws 24 secure a sheet member 23 to beams 22. Sheet members 23 may be square or rectangular or have still other polygonal outline as in the case of the embodiment of FIGS. 1 through 3. Or members 23 may be continuous in nature and cut to a desired length from rolls 25 of the material as represented in FIG. 6. This is especially convenient when sheet members 23 are fabricated from flexible polymeric resins, such as polyvinyl chloride, polypropylene, polyethylene, nylon, and the like.

In either case, sheet member 23 has a light-reflecting color 26 on one side and a light-absorbing color 27 on the opposite side. In the warmer seasons, sheet members 23 are secured to beams 22 with the light-reflecting colored side 26 directed away from roof $R_1$ as shown by the left hand portion of FIG. 4. Elevating means in the form of beams 22 space sheet members 23 with respect to roof $R_1$ to form an air space 28 therebetween. In this manner, sheet members 23 shade the roof, and the light-reflecting colored side 26 reflects heat away from the roof, while air space 28 allows air to circulate between sheet members 23 and roof $R_1$. Sheet members 23 may have slots or other openings if desired. During the colder seasons, fasteners 24 are removed and sheet members 23 are placed in reverse positions, that is, with the light-absorbing colored side 27 directed away from the roof, while the light-reflecting colored side 26 faces the roof, as shown by the right hand portion of FIG. 4. In this embodiment, air space 28 always remains. Fasteners 24 are then replaced to secure sheet members 23 in place.

Figure 7:
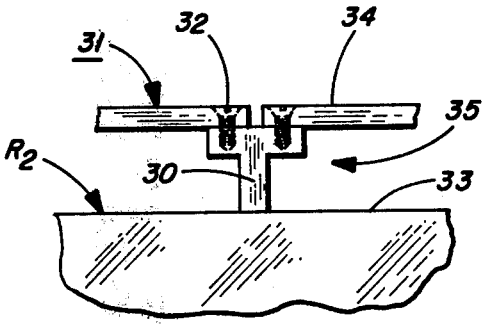
FIG. 7 is an enlarged, fragmentary view, similar to FIG. 5, and shows another modification of the invention as well as another manner of detachably securing a sheet member of a unit with respect to a roof.

It is also within the contemplation of the invention to separate those elements which bear the light-reflecting and light-absorbing colors. FIG. 7 illustrates an embodiment of this modification in which spaced apart beams, as in the manner of FIG. 4, extend from one end of a roof $R_2$ to the other. As a further modification, it will be noted that the elevating means in the form of beams 30 have T-shaped cross-sections. Such beams are conveniently fabricated from metal such as aluminum and may be used in any of the embodiments of the invention. Sheet members 31 bridge adjacent beams 30 and may be of polygonal outline or continuous outline as from a roll 25 of the material of FIG. 6. Suitable fasteners such as screws 32 secure sheet members 31 to beams 30.

In this embodiment roof $R_2$ has a light-absorbing color 33, and the upper or exposed side 34 of sheet member 31 has a light-reflecting color. For example, roof $R_2$ may have an asphalt coat which advantageously and automatically provides it with a black, light-absorbing color over its complete surface. During the warmer seasons, the parts are assembled as shown in FIG. 7, in which sheet members 31 shade roof $R_2$ with their light-reflecting colored sides 34 directed away from the roof. Elevating means in the form of beams 30 integral with the roof space sheet members 31 away from the roof to form an air space 35 therebetween. Operation of the parts in this position is as previously described. During the colder seasons, fasteners 32 are removed and sheet members 31 are stored. With sheet members 31 withdrawn, the light-absorbing color 33 on roof $R_2$ absorbs heat and aids in thermally insulating the roof.

In any of the embodiments, it is not necessary that the elevating means be integral with either the roof or sheet member. Instead, spacing means may be inserted between the roof and member and merely physically contacts those parts. For example, such spacing means may comprise an interconnecting network or grid of pipes, rods, slats, boards, and the like joined at various junctures by any suitable means, such as "T" connectors.

Although the invention has been described and illustrated for flat top roofs, it is understood that the present roof utility unit can be installed as well on slanting roofs. If desired, the lowermost row of units in this case can be maintained in position by retaining means engaging any portion of the units of that row. This row, then, holds in place a succeeding higher row, and each row thereafter, in turn, holds in place the next higher, contiguous row.

Although the foregoing describes several preferred embodiments of the invention, it is understood that the invention may be practiced in still other forms within the scope of the following claims.

I claim:

1. A reversible, all seasonal roof utility unit adapted to be placed in juxtaposition with other like units in covering a substantial portion of a roof, said unit comprising a substantially horizontally disposed sheet member having a light-absorbing color on one side and light-reflecting color on the opposite side, and elevating means adapted to elevate said sheet member with respect to the roof to form an air space therebetween, said sheet member being adapted for reversible positioning in substantially a horizontal plane with respect to said roof, whereby the light-absorbing colored side is directed away from said roof during the colder seasons, and the light-reflecting colored side is directed away from said roof during the warmer seasons.

2. The roof utility unit of claim 1 in which said sheet member has a polygonal outline.

3. The roof utility unit of claim 1 in which said light-absorbing color is black.

4. The roof utility unit of claim 1 in which said light-reflecting color is white.

5. The roof utility unit of claim 1 in which said elevating means is integral with the roof and support the sheet member.

6. The roof utility unit of claim 1 in which said elevating means is not integral with either said roof or sheet member.

7. The roof utility unit of claim 1 in which said sheet member has openings.

8. The roof utility unit of claim 1 in which said elevating means are beam members extending across the roof and are adapted to receive and support said sheet member.

9. The roof utility unit of claim 8 in which said support member is detachably secured to at least one beam member.

10. The roof utility unit of claim 1 in which said elevating means is integral with the sheet member and disposed to one side thereof, said one side has the light-absorbing color and the remaining, opposite side of the sheet member has the light-reflecting color, whereby when said one side is directed away from the roof during the winter season, said elevating means is also similarly directed away from the roof, said air space is eliminated, and said sheet member substantially directly contacts the roof.

11. Reversible, all seasonal roof utility means comprising a plurality of the roof units of claim 1 arranged in side-by-side relation.

12. In combination: a roof having a plurality of reversible, all seasonal roof utility units of claim 1 arranged in side-by-side relation and extending across said roof.

13. A reversible, all seasonal roof utility unit adapted to be placed in juxtaposition with other like units in covering a substantial portion of a substantially horizontally disposed roof, said unit comprising a sheet member having a polygonal outline provided with a light-absorbing color on one side and light-reflecting color on the opposite side, runner means extending along the side of said sheet member having the light-absorbing color adapted to rest on said roof and space the sheet member therefrom to form an air space therebetween, said sheet member being adapted for reversible positioning in substantially a horizontal plane with respect to said roof whereby the light-reflecting colored side is directed away from said roof during the warmer seasons and said air space is preserved to aid in radiating heat from the roof, and whereby the light-absorbing side and also said runner means are directed away from the roof during the colder seasons, said air space is eliminated, and said sheet member substantially directly contacts the roof to aid in retaining heat at the roof.

14. The roof utility unit of claim 13 in which said sheet member has air openings.

15. In combination: a substantially horizontally disposed roof having a light-absorbing color, a detachable roof insulating unit adapted to be placed in juxtaposition with other like units in covering a substantial portion of said roof, said unit comprising a substantially horizontally disposed sheet member having a light-reflecting color on one side, elevating means adapted to elevate said sheet member with respect to the roof and form an air space therebetween, and means for detachably securing said unit with respect to said roof in said elevating position with the side having the light-reflecting color disposed away from the roof, whereby said light-reflecting side of the sheet member is exposed during the warmer seasons, and the sheet member can be removed to expose the roof and its light-absorbing color during the colder seasons.

* * * * *